US009731519B2

(12) United States Patent
Iijima et al.

(10) Patent No.: US 9,731,519 B2
(45) Date of Patent: Aug. 15, 2017

(54) CONVEYING DEVICE AND IMAGE RECORDING APPARATUS

(71) Applicant: Brother Kogyo Kabushiki Kaisha, Nagoya-shi, Aichi-ken (JP)

(72) Inventors: Shota Iijima, Nagoya (JP); Iwane Sano, Obu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/055,919

(22) Filed: Feb. 29, 2016

(65) Prior Publication Data

US 2016/0279971 A1 Sep. 29, 2016

(30) Foreign Application Priority Data

Mar. 25, 2015 (JP) ..... 2015-062733

(51) Int. Cl.

| | |
|---|---|
| ***B41J 2/01*** | (2006.01) |
| ***B41J 11/00*** | (2006.01) |
| ***B65H 5/36*** | (2006.01) |
| ***B65H 5/06*** | (2006.01) |
| ***B65H 3/06*** | (2006.01) |
| ***B41J 13/10*** | (2006.01) |

(52) U.S. Cl.

CPC ..... *B41J 11/007* (2013.01); *B41J 13/103* (2013.01); *B65H 3/0684* (2013.01); *B65H 5/06* (2013.01); *B65H 5/36* (2013.01)

(58) Field of Classification Search

CPC ..... B41J 13/103; B41J 11/42; B41J 11/006; B41J 11/007; B65H 5/36; B65H 5/062; B65H 3/0684; B65H 5/06

USPC ..... 347/14, 16, 104; 271/3.14, 3.18, 3.19

See application file for complete search history.

(56) References Cited

U.S. PATENT DOCUMENTS

| | | | | |
|---|---|---|---|---|
| 7,708,398 | B2 | 5/2010 | Niioka et al. | |
| 2008/0074458 | A1 | 3/2008 | Niioka et al. | |
| 2014/0138901 | A1* | 5/2014 | Takahata | B65H 5/36 271/3.19 |

FOREIGN PATENT DOCUMENTS

| | | | |
|---|---|---|---|
| JP | 2008-074063 | A | 4/2008 |

* cited by examiner

*Primary Examiner* — Jannelle M Lebron
(74) *Attorney, Agent, or Firm* — Banner & Witcoff, Ltd.

(57) ABSTRACT

In a conveying device, a cover member includes a guide portion and is configured to move relative to a casing between a first position at which the guide portion defines a first conveying path, and a second position at which the guide portion exposes the first conveying path to an exterior of the conveying device. A conveying unit is configured to convey a medium along a second conveying path. A flap is supported by the cover member and pivotable about a pivot axis between a third position and a fourth position. The flap is configured to guide the medium toward the conveying unit. A restricting mechanism is configured to selectively allow and restrict pivoting of the flap to the fourth position.

17 Claims, 12 Drawing Sheets

CONVEYING DEVICE AND IMAGE RECORDING APPARATUS

CROSS-REFERENCE TO RELATED APPLICATION

This application claims priority from Japanese Patent Application No. 2015-062733 filed on Mar. 25, 2015, the content of which is incorporated herein by reference in its entirety.

FIELD OF DISCLOSURE

The disclosure relates to a conveying device configured to convey a medium and an image recording apparatus comprising the conveying device and configured to record an image on the medium.

BACKGROUND

A known image recording apparatus comprises a conveying device configured to convey a medium, e.g., a sheet of paper. The conveying device conveys a medium from a feed unit along a conveying path and a medium from a reversing unit along another conveying path. The conveying device includes a flap disposed at a junction between the two conveying paths and configured to pivot to guide a medium selectively to one of the conveying paths.

Another known conveying device comprises a cover pivotally or detachably attached to the conveying device. The cover includes a guide portion configured to define a conveying path. The cover, when pivoted or detached, facilitates removal of a medium jammed in the conveying path.

SUMMARY

It may be beneficial to provide a conveying device comprising a movable cover which includes a guide portion configured to define a conveying path, and a flap supported by the movable cover such that pivoting of the flap is selectively allowed and restricted.

According to one or more aspects of the disclosure, a conveying device comprises a casing, a cover member, a conveying unit, a flap, and a restricting mechanism. The cover member includes a guide portion and is configured to move relative to the casing between a first position at which the guide portion defines a first conveying path, and a second position at which the guide portion exposes the first conveying path to an exterior of the conveying device. The conveying unit is configured to convey a medium along a second conveying path. The flap is supported by the cover member and pivotable about a pivot axis between a third position and a fourth position. The flap is configured to guide the medium toward the conveying unit. The restricting mechanism is configured to selectively allow and restrict pivoting of the flap to the fourth position.

DETAILED DESCRIPTION

Figure 1:
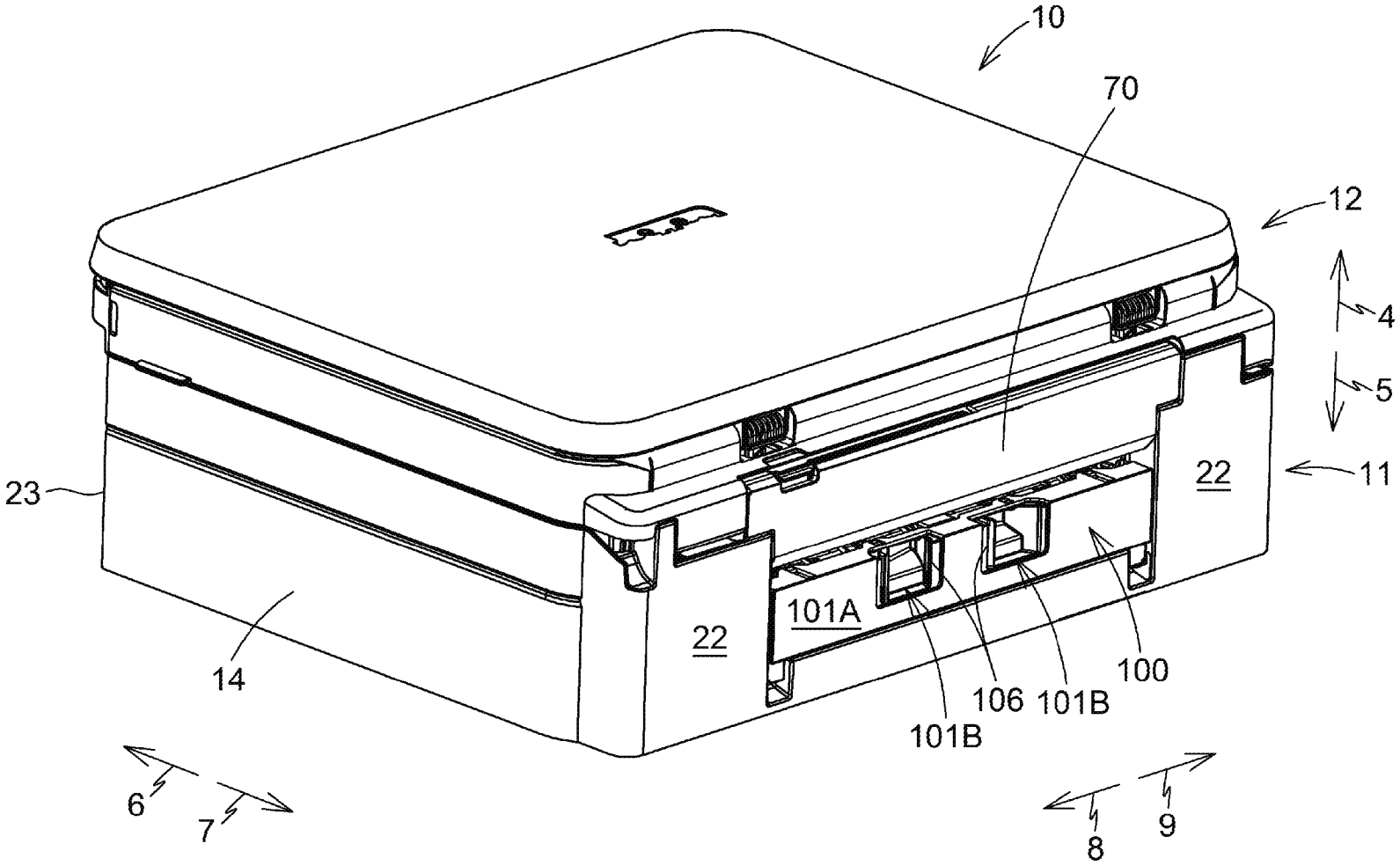
FIG. 1 is a perspective view of a multi-functional apparatus, in an illustrative embodiment according to one or more aspects of the disclosure, when a cover member thereof is at a first position.

A multi-functional apparatus 10 according to the disclosure will be described below. While the disclosure is described in detail with reference to specific embodiments thereof, this is merely an example, and various changes, arrangements and modifications may be applied therein without departing from the spirit and scope of the disclosure. In the following description, an up direction 4 and a down direction 5 (which may be simply referred to as "upward" and "downward," respectively, or may be collectively referred to as the "up-down direction 4 and 5") is defined in conjunction with an orientation, as depicted in FIG. 1, in which the multi-functional apparatus 10 is intended to be used. A side or surface of the multi-function apparatus 10 having an opening portion 13 (refer to FIG. 2) is defined as a rear side or a rear surface 22, respectively. A front direction 6 and a rear direction 7 (which may be simply referred to as "frontward" and "rearward," respectively, or may be collectively referred to as the "front-rear direction 6 and 7") is defined in conjunction with the rear side. A right direction 8 and a left direction 9 (which may be simply referred to as "rightward" and "leftward," respectively, or collectively referred to as the "right-left direction 8 and 9") is defined in conjunction with the multi-functional apparatus 10 as viewed from its front side, e.g., a front surface 23 facing the rear surface 22.

[Overall Structure of Multi-Functional Apparatus 10]

Figure 2:
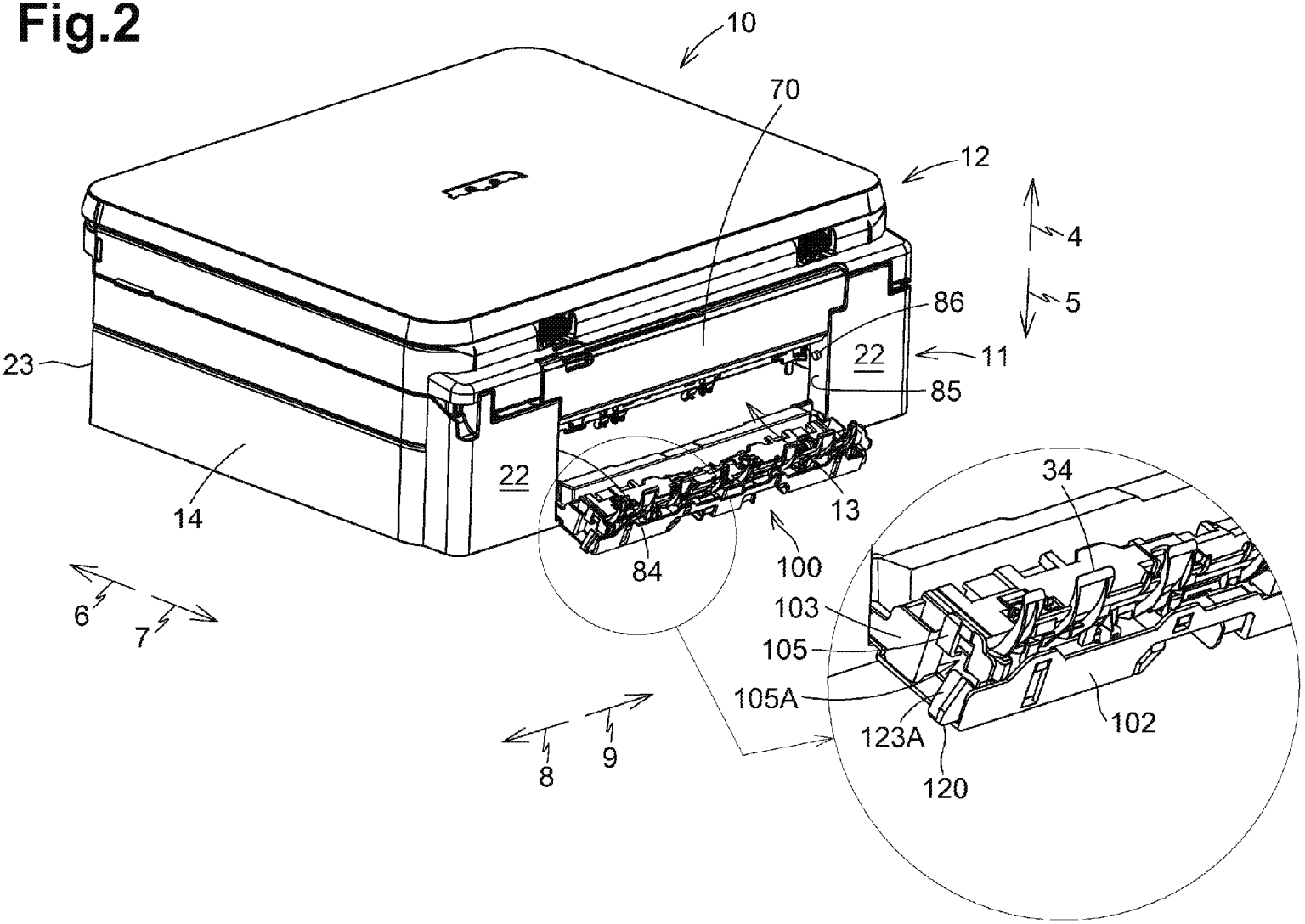
FIG. 2 is a perspective view of the multi-functional apparatus when the cover member is at a second position.

As depicted in FIGS. 1 and 2, an image recording apparatus, e.g., the multi-functional apparatus 10, is formed to have a generally rectangular parallelepiped shape and includes a printer unit 11 configured to record an image by an ink-jet recording method on a medium, e.g., a sheet such as a recording sheet. The multi-functional apparatus 10 has various functions, e.g., a facsimile function and a printing function. The multi-functional apparatus 10 has a function of recording an image on a surface of another type of medium, e.g., a recording medium such as a CD-ROM and a DVD-ROM, having a greater thickness than the sheet.

In the illustrative embodiment, the recording medium is configured to be conveyed, while being supported by a plate-shaped media tray (not depicted), along a second conveying path, e.g., a straight path 65B (refer to FIG. 3), and a third conveying path, e.g., a label path 67 (refer to FIG. 3), which are described below. In another embodiment, the recording medium itself may be conveyed without being supported by the media tray along the straight path 65B and the label path 67.

The printer unit 11 includes a casing 14 having the opening portion 13 (refer to FIG. 2) formed in the rear surface 22 and an opening portion 16 (refer to FIG. 3) formed in the front surface 23.

As depicted in FIG. 2, a right end of the opening portion 13 is defined by a side wall 84 and a left end of the opening portion 13 is defined by a side wall 85. Each of the side walls 84 and 85 has an engaged portion, e.g., a protrusion 86, formed thereon. The protrusion 86 formed on the side wall 84 protrudes leftward. The protrusion 86 formed on the side wall 85 protrudes rightward. In FIG. 2, the protrusion 86 formed on the side wall 84 is hidden by the rear surface 22 and cannot be seen.

Figure 3:
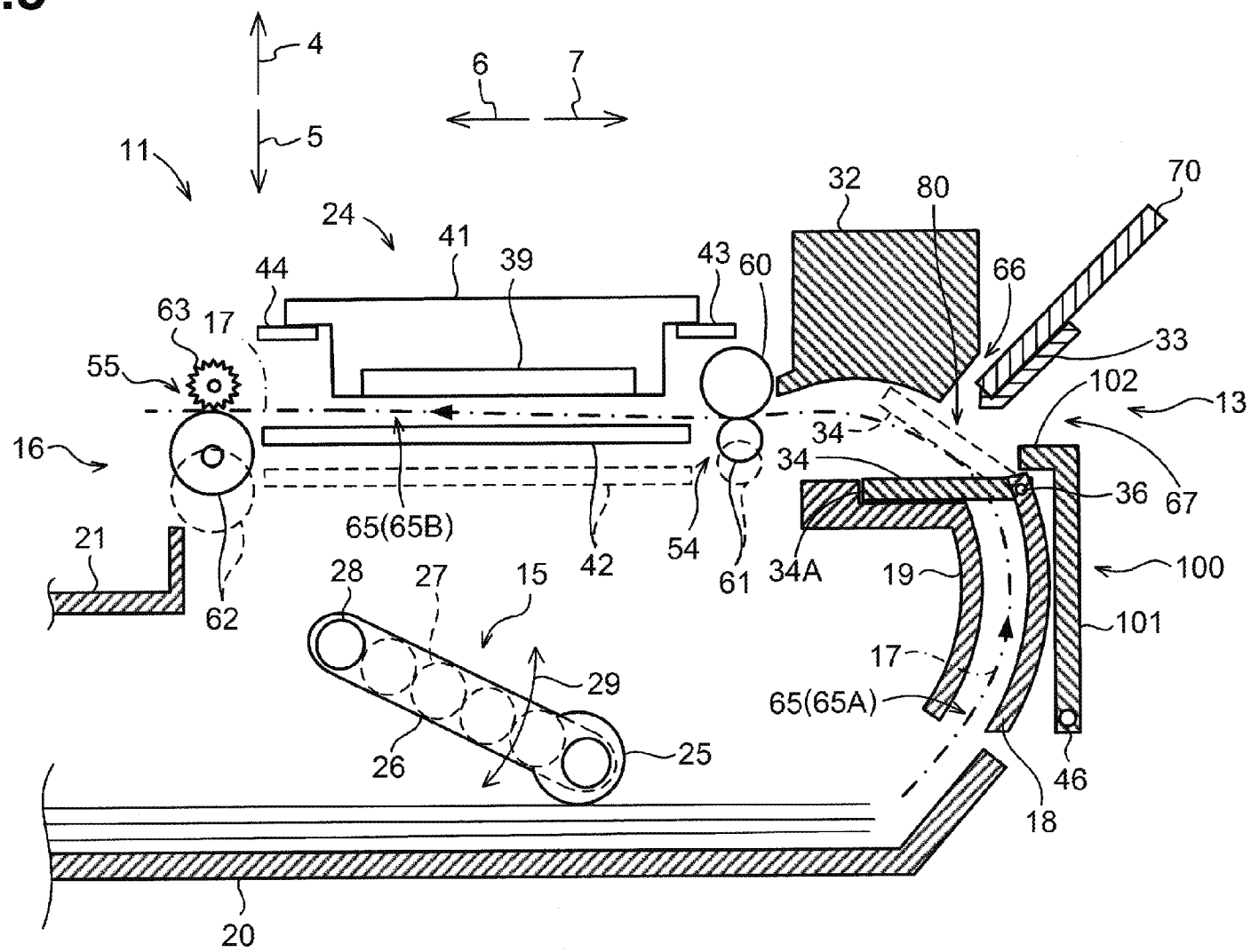
FIG. 3 is a vertical cross-sectional view of a printer unit of the multi-functional apparatus, depicting an internal structure of the printer unit.

As depicted in FIG. 3, a feed tray 20 and a discharge tray 21 that support sheets of various sizes are configured to be inserted in the rear direction 7 into the opening portion 16 and removed in the front direction 6 from the opening portion 16.

As depicted in FIG. 3, the printer unit 11 includes a feed unit 15 configured to feed a sheet from the feed tray 20, a recording unit 24 configured to record an image on the sheet, a conveying unit, e.g., a first conveying roller pair 54 and a second conveying roller pair 55, configured to convey the sheet and the media tray, a conveying path 65, the label path 67, and a fourth conveying path, e.g., a bypass path 66. For example, the feed unit 15, the recording unit 24, the first conveying roller pair 54, and the second conveying roller pair 55 are disposed inside the casing 14. The conveying path 65, the label path 67, and the bypass path 66 are formed or defined inside the casing 14.

The printer unit 11 includes a conveying device configured to convey a sheet. The conveying device includes the casing 14 (refer to FIGS. 1 and 2), the first conveying roller pair 54 (refer to FIGS. 3-5), the second conveying roller pair 55 (refer to FIGS. 3-5), a cover member 100 (refer to FIGS. 1-5), flaps 34 (refer to FIGS. 3-5 in which only one flap 34 is depicted), and a restricting mechanism 120 (refer to FIGS. 6-11).

As depicted in FIG. 1, a scanner unit 12 is disposed above the printer unit 11. The scanner unit 12 may be a flatbed scanner. The structure of a flatbed scanner is known, so a detailed description thereof is omitted herein.

[Printer Unit 11]

A detailed structure of the printer unit 11 will be described below.

[Feed Tray 20]

Figure 4:
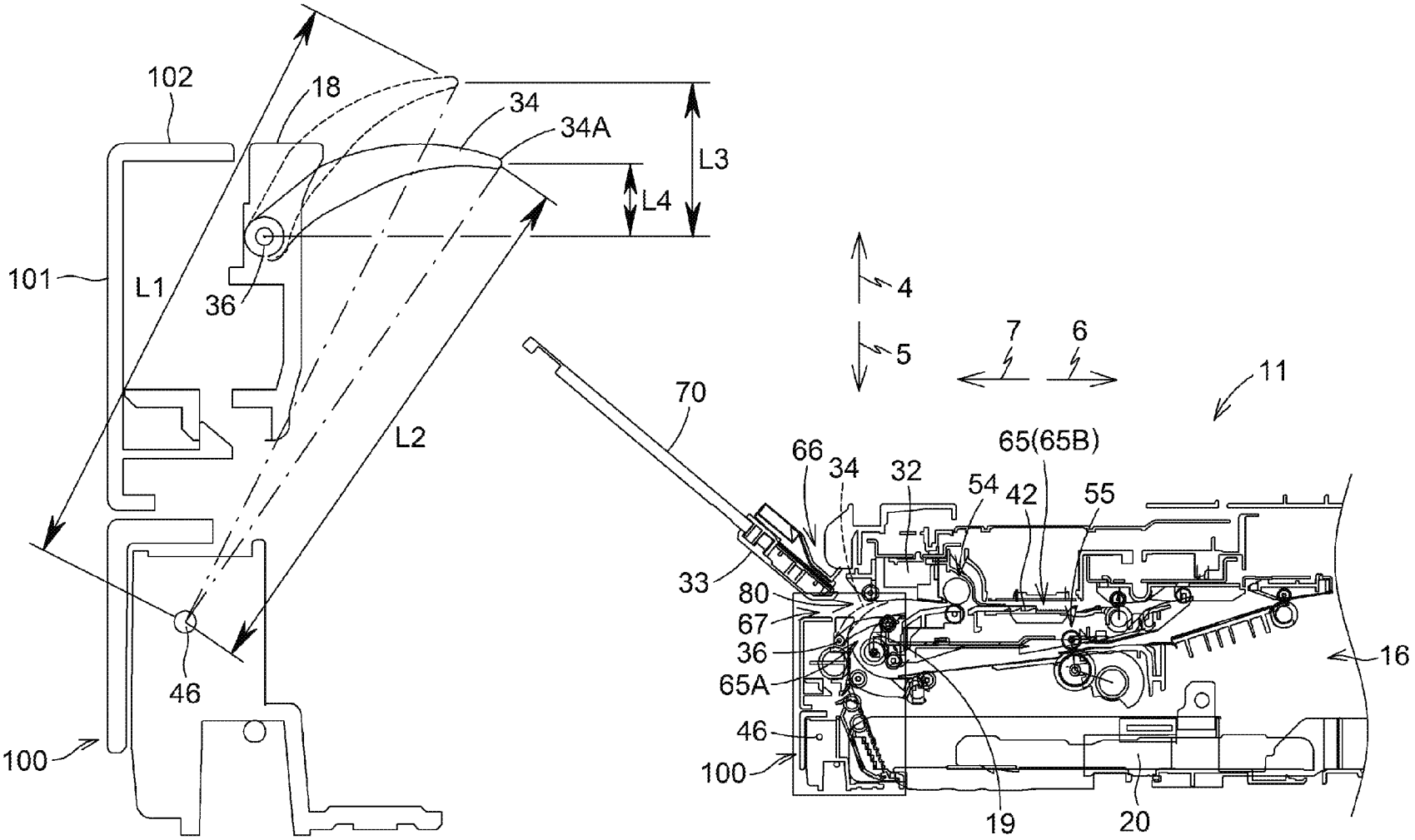
FIG. 4 is a vertical cross-sectional view of the printer unit, depicting an internal structure thereof, when the cover member is at the first position.
Figure 5:
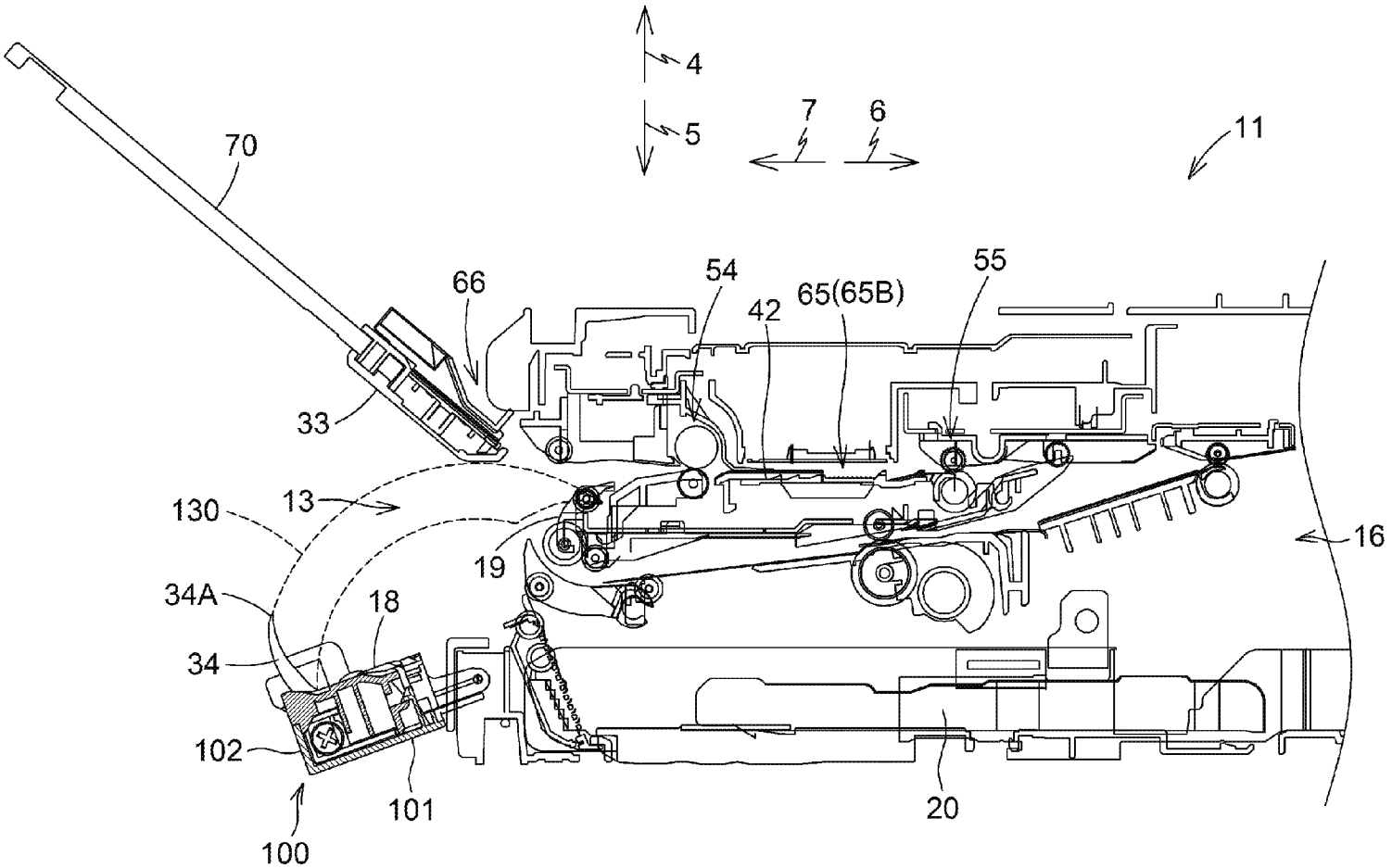
FIG. 5 is a vertical cross-sectional view of the printer unit, depicting an internal structure thereof, when the cover member is at the second position.

The feed tray 20, as depicted in FIGS. 3-5, is shaped like a box with an open top. As depicted in FIG. 3, the discharge tray 21 is disposed above the feed tray 20. The feed tray 20 is configured to support, on a support surface thereof, a stack of sheets of various sizes, for example, from the A4 size specified in Japanese Industrial Standards to the L (large) size used in photographic recording. The feed tray 20 is configured to be accommodated in an interior space of the casing 14 leading to the opening portion 16.

[Feed Unit 15]

As depicted in FIG. 3, the feed unit 15 includes a feed roller 25, a feed arm 26, and a driving force transmission mechanism 27. The feed unit 15 is disposed above the support surface of the feed tray 20 and below the recording unit 24. The feed roller 25 is rotatably supported at a distal portion of the feed arm 26. The feed arm 26 is configured to pivot about a shaft 28 provided at a base end thereof, in a direction indicated by an arrow 29. In response to the feed arm 26 pivoting, the feed roller 25 moves into contact with and away from the support surface of the feed tray 20. Accordingly, the feed roller 25 may contact an uppermost sheet accommodated in the feed tray 20 when the feed tray 20 having a stack of sheets accommodated therein is installed in the casing 14.

A driving force is transmitted from a motor (not depicted) to the feed roller 25 via the driving force transmission mechanism 27. The driving force transmission mechanism 27 is configured to transmit the driving force transmitted to the shaft 28 to a shaft of the feed roller 25 through a gear train including a plurality of gears that are engaged with each other. In response to the feed roller 25 rotating while being in contact with the uppermost one of the sheets supported on the support surface of the supply tray 20, the uppermost sheet is fed to the conveying path 65.

[Conveying Path 65]

As depicted in FIG. 3, the conveying path 65 provided in the interior space of the casing 14 extends from a rear end portion of the feed tray 20 upward while curving, and frontward to the discharge tray 21. The conveying path 65 includes a first conveying path, e.g., a curve path 65A, and the straight path 65B continuous with the curve path 65A.

The curve path 65A is defined by a guide portion, e.g., an outer guide member 18, and an inner guide member 19 that face each other with a space therebetween to allow a sheet to pass therebetween. The straight path 65B extends frontward from a junction 80 where the straight path 65B joins the curve path 65A, so that the media tray may pass through the straight path 65B without bending. The straight path 65B is defined by the recording unit 24 and a platen 42 that face each other with a space therebetween to allow a sheet and the media tray to pass therebetween, as well as by the inner guide member 19 and a guide member 32 that face each other with a space therebetween to allow a sheet and the media tray to pass therebetween.

A sheet fed along the conveying path 65 by the feed roller 25 of the feed tray 20 is conveyed upward along the curve path 65A while making U-turn and frontward along the straight path 65B. For example, the sheet is conveyed along a conveying direction 17 as depicted by a dot-and-dash line with an arrow in FIG. 3. The conveying direction 17 is orthogonal to the right-left direction 8 and 9. The right-left direction 8 and 9 is an example of a width direction.

The outer guide member 18 includes a guide surface configured to guide a sheet when the sheet is conveyed along the curve path 65A. The inner guide member 19 includes a guide surface configured to guide a sheet when the sheet is conveyed along the curve path 65A and when the sheet is conveyed along the straight path 65B. The guide member 32 includes a guide surface configured to guide a sheet when the sheet is conveyed along the straight path 65B. The guide member 32 defines the bypass path 66 (described below). Each of the guide surfaces may be defined by a single surface or distal end faces of a plurality of ribs.

[First Conveying Roller Pair 54 and Second Conveyance Roller Pair 55]

As depicted in FIG. 3, the first conveying roller pair 54 is disposed in the straight path 65B at a position upstream of the recording unit 24 in the conveying direction 17. The first conveying roller pair 54 includes a first conveying roller 60 and a pinch roller 61. The second conveying roller pair 55 is disposed in the straight path 65B at a position downstream of the recording unit 24 in the conveying direction 17. The second conveying roller pair 55 includes a second conveying roller 62 and a spur roller 63. The first conveying roller 60 and the second conveying roller 62 are configured to rotate in response to rotation of the motor (not depicted) thereto. Thus, the first conveying roller pair 54 and the second conveying roller pair 55 convey a sheet, while nipping the sheet, along the conveying direction 17.

[Recording Unit 24]

As depicted in FIG. 3, the recording unit 24 is disposed between the first conveying roller pair 54 and the second conveying roller pair 55 in the straight path 65B. The recording unit 24 includes a carriage 41 and a recording head 39. The carriage 41 is supported by guide rails 43 and 44 disposed above the platen 42 to reciprocate in the right-left direction 8 and 9. A known belt mechanism is disposed at the guide rail 44. The carriage 41 is coupled to an endless belt of the belt mechanism and configured to reciprocate in the right-left direction 8 and 9 along the guide rails 43 and 44, in response to the rotation of the endless belt. The carriage 41, the recording head 39 and the platen 42 define a portion of the straight path 65B when the carriage 41 and the recording head 39 face the platen 42 with a space therebetween.

The recording head 39 is mounted on the carriage 41. The recording head 39 have a plurality of nozzles (not depicted) formed in a lower surface thereof. The recording head 39 is configured to receive ink from an ink cartridge (not depicted). The recording head 39 is configured to selectively eject ink from the nozzles as very small ink droplets. While the carriage 41 is moving in the right-left direction 8 and 9, the ink droplets are ejected from the nozzles onto a sheet that is conveyed along the straight path 65B or a recording medium that is supported on the media tray and conveyed along the straight path 65B. The ejected ink droplets adhere to the sheet on the platen 42 or the recording medium on the media tray, to record an image on the sheet or the recording medium.

[Movements of Roller Pairs 54 and 55 and Platen 42]

Lower rollers of the first conveying roller pair 54 and the second conveying roller pair 55, e.g., the pinch roller 61 and the second conveying roller 62, respectively, and the platen 42 are configured to move in the up-down direction 4 and 5.

Each of the pinch roller 61 and the second conveying roller 62 is configured to move between an upper position (e.g., the position indicated by a solid line in FIG. 3) in which the pinch roller 61 and the second conveying roller 62 are in contact with the first conveying roller 60 and the spur roller 63, respectively, and a lower position (e.g., the position indicated by a broken line in FIG. 3) in which the pinch roller 61 and the second conveying roller 62 are spaced from the first conveying roller 60 and the spur roller 63, respectively.

The movement of the pinch roller 61 and the second conveying roller 62 may be realized by a known structure. For example, in the illustrative embodiment, a lever portion (not depicted) provided in the interior space leading to the opening portion 16 is coupled to a support member (not depicted) that supports the pinch roller 61 and the second conveying roller 62. In response to the lever portion moved frontward by a user, the support member moves downward. In response to the lever portion moved rearward by a user, the support member moves upward. In response to the support member moved in the up-down direction 4 and 5, the pinch roller 61 and the second conveying roller 62 move between the upper position and the lower position. In another embodiment, the movement of the pinch roller 61 and the second conveying roller 62 may be realized by other structures. For example, the pinch roller 61 and the second conveying roller 62 may be moved by drive force from a motor (not depicted).

The first conveying roller pair 54 and the second conveying roller pair 55 are configured to nip a sheet between the rollers 60 and 61, and 62 and 63 when the pinch roller 61 and the second conveying roller 62 are at the upper position. The first conveying roller pair 54 and the second conveying roller pair 55 are configured to nip the media tray between the rollers 60 and 61, and 62 and 63 when the pinch roller 61 and the second conveying roller 62 are at the lower position. The first conveying roller pair 54 and the second conveying roller pair 55 are configured to convey the sheet along the straight path 65B or the media tray along the straight path 65B and the label path 67 while nipping the sheet or the media tray, in response to the rotation of the first conveying roller 60 and the second conveying roller 62.

The platen 42 is configured to move between an upper position (e.g., the position indicated by a solid line in FIG. 3) in which a distance in the up-down direction 4 and 5 between a sheet supported by the platen 42 and the recording head 39 is equal to a distance suitable for image recording onto the sheet, and a lower position (e.g., the position indicated by a broken line in FIG. 3) which is lower than the upper position and is located below the media tray conveyed along the straight path 65B. The movement of the platen 42 may be realized by a known structure, similarly to the rollers 61 and 62. For example, a support member that supports the platen 42 is coupled to the lever portion. In response to the support member moving in association with the movement of the lever portion, the platen 42 moves in the up-down direction 4 and 5.

[Label Path 67]

As depicted in FIGS. 3 and 4, the label path 67 is formed or provided inside the casing 14 and extends rearward from the junction 80. The label path 67 and the straight path 65B constitute a single path extending substantially along the front-rear direction 6 and 7. With this structure, the label path 67, together with the straight path 65B may guide the media tray without bending the media tray.

The label path 67 is defined by a second wall 102 (described below) of the cover member 100 and a guide member 33 that face each other with a space therebetween that allows the media tray to pass through the space. As depicted in FIG. 4, the guide member 33 is attached to a lower end portion of the bypass tray 70.

The label path 67 may allow the media tray to pass therethrough while contacting the outer guide member 18 or the guide member 33. Alternatively, the label path 67 may allow the media tray to pass therethrough without contacting the outer guide member 18 or the guide member 33.

[Bypass Path 66]

As depicted in FIGS. 3 and 4, the bypass path 66 is formed or provided inside the casing 14 and extends from a position behind and above the straight path 65B toward the junction 80. Inside the casing 14, the bypass path 66 extends diagonally frontward and downward and is connected to the straight path 65B at the junction 80. The bypass path 66 is located above the curve path 65A, the straight path 65B, and the label path 67. The bypass path 66 is defined by the guide member 32 and a tray, e.g., the bypass tray 70 (described below), that face each other with a space therebetween that allows the sheet to pass through the space.

A sheet supported by the bypass tray 70 is guided frontward and downward along the bypass path 66. The sheet is guided along the straight path 65B of the conveying path 65, and conveyed by the first conveying roller pair 54. The sheet is subjected to image recording by the recording unit 24, and discharged onto the discharge tray 21.

[Bypass Tray 70]

As depicted in FIGS. 1-5, the bypass tray 70 is disposed at the rear surface 22 of the multi-functional apparatus 10 and above the outer guide member 18. The bypass tray 70 is configured to support a sheet. The bypass tray 70 pivotally supported by the casing 14 between a non-usable state in which the bypass tray 70 stands vertically and a usable state in which the bypass tray 70 is inclined relative to the casing 14. FIGS. 1 and 2 depict the bypass tray 70 in the non-usable state. FIGS. 3-5 depict the bypass tray 70 in the usable state.

In the illustrative embodiment, the bypass tray 70 supports a sheet with a leading end thereof in contact with the first conveying roller pair 54. In this state, as the first conveying roller 60 rotates, the sheet supported by the bypass tray 70 is conveyed along the straight path 65B in the conveying direction 17.

The bypass tray 70 may support a sheet with a leading end thereof out of contact with the first conveying roller pair 54. In this case, a feed roller having a structure similar to the feed roller 25 may be provided at a position facing a sheet support surface of the bypass tray 70. In response to the feed roller rotating, an uppermost sheet of a stack of sheets supported by the bypass tray 70 is fed to the straight path 65B via the bypass path 66.

[Cover Member 100]

As depicted in FIGS. 1-3, the printer unit 11 includes the cover member 100 configured to pivot. In the following description of structures of the cover member 100, the up direction 4, the down direction 5, the front direction 6, the rear direction 7, the right direction 8, and the left direction 9 are defined in conjunction with an orientation in which the cover member 100 is located at a position as depicted in FIGS. 1 and 4.

Figure 6:
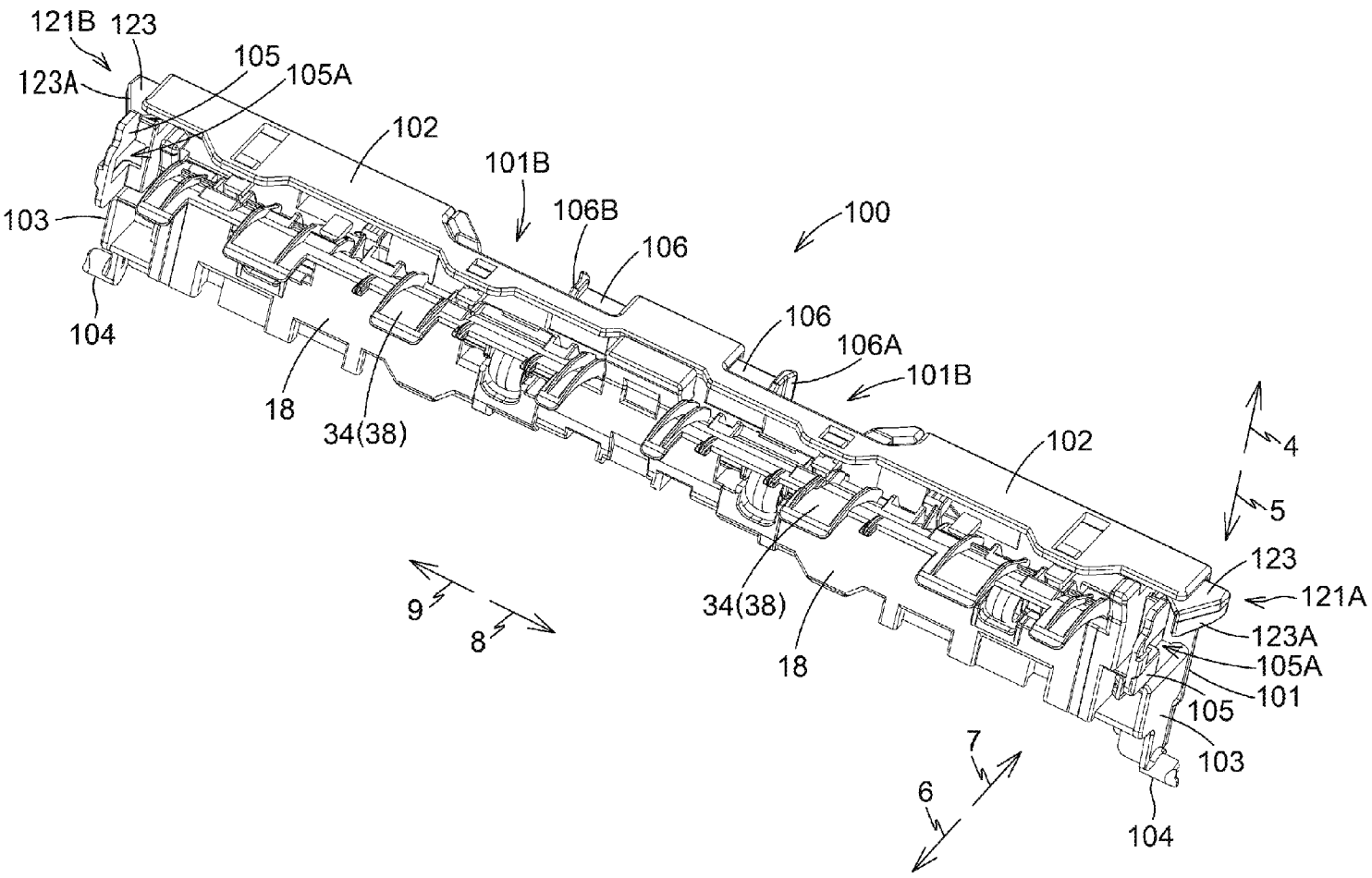
FIG. 6 is a perspective view of the cover member when movable members of the printer unit are at respective contact positions.
Figure 7:
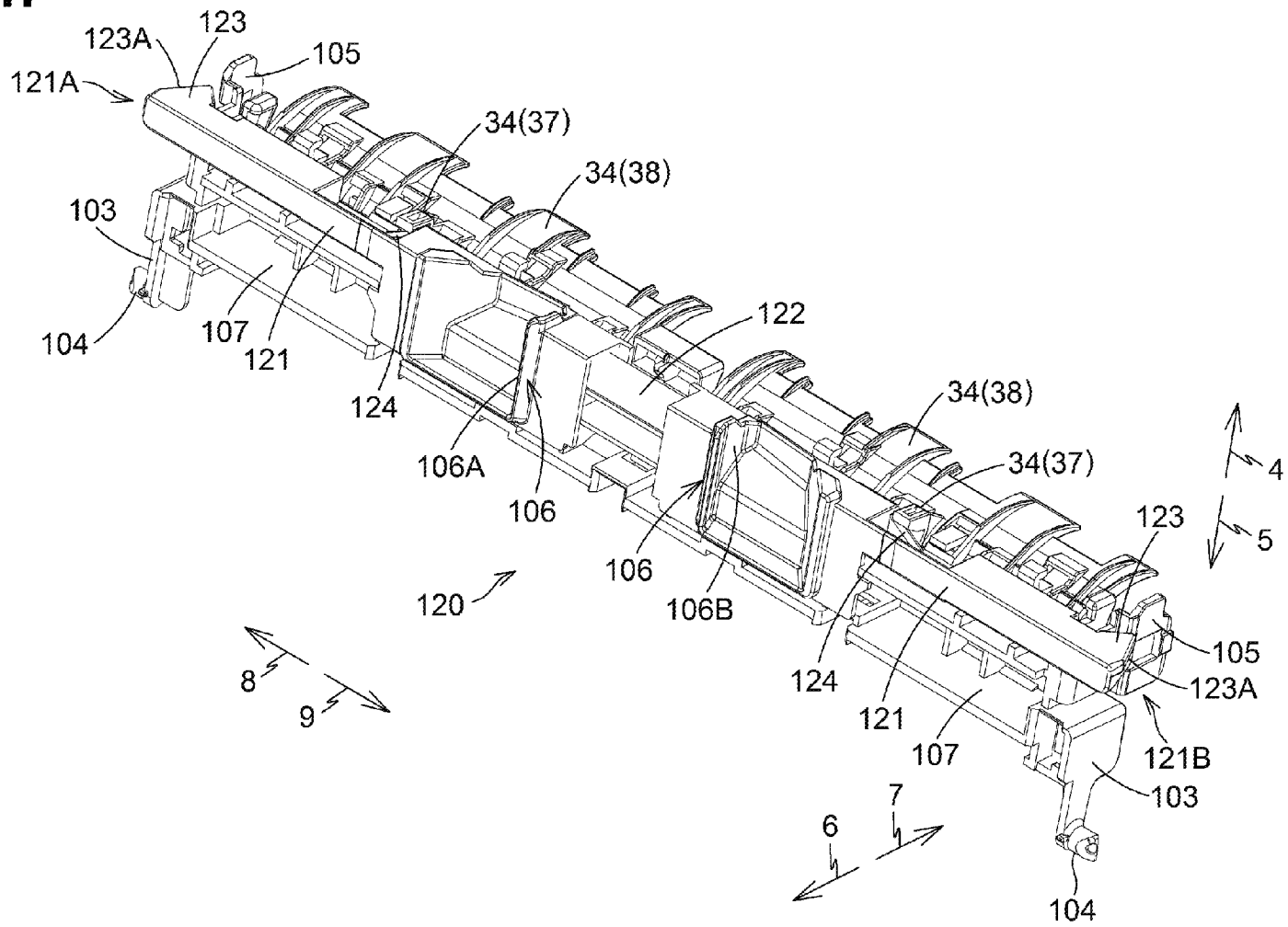
FIG. 7 is a perspective view of the cover member when the movable members are at the respective contact positions, in which a first wall and a second wall of the cover member are omitted.

As depicted in FIGS. 6 and 7, the cover member 100 includes the outer guide member 18 (described above), a first wall 101, the second wall 102, a pair of right and left third walls 103, a fourth wall 107, a pair of right and left protruding portions 104, a pair of right and left engaging portions 105, and a pair of right and left operative portions 106.

The first wall 101 is located behind the outer guide member 18. The first wall 101 supports the outer guide member 18 from behind. In the illustrative embodiment, a rear surface 101A (refer to FIG. 1) of the first wall 101 is flush with the rear surface 22 of the casing 14. In another embodiment, the rear surface 101A may not be flush with the rear surface 22. A central portion of the first wall 101 in the right-left direction 8 and 9 has right and left openings 101B formed therein. The openings 101B are formed with a space therebetween in the right-left direction 8 and 9. Each of the operative portions 106 is provided in a respective one of the openings 101B.

The second wall 102 extends frontward from an upper end portion of the first wall 101. As described above, the second wall 102 partially defines the label path 67.

Each of the third walls 103 extends frontward from a right or left end portion of the first wall 101. The fourth wall 107 connects the third walls 103. The fourth wall 107 supports the outer guide member 18 from below.

One of the protruding portions 104, e.g., the right protruding portion 104, protrudes rightward from a lower end portion of the right third wall 103. The other one of the protruding portions 104, e.g., the left protruding portion 104, protrudes leftward from a lower end portion of the left third wall 103. The right and left protruding portions 104 are aligned in the right-left direction 8 and 9. Each of the protruding portions 104 is inserted into a corresponding opening (not depicted) formed on a lower end portion of a respective one of the side walls 84 and 85 of the casing 14. Thus, the cover member 100 is pivotally supported by the casing 14 about a pivot axis 46 (refer to FIG. 4) passing through the centers of the protruding portions 104 and extending in the right-left direction 8 and 9.

Each of the engaging portions 105, which are located above the third walls 103, extends frontward from a respective one of right and left end portions of the first wall 101. As each engaging portion 105 is contacted by and pressed by a protruding portion 123 of a corresponding one of the movable members 121 of a restricting mechanism 120 (described below), a front end portion of each engaging portion 105 (e.g., a distal end portion of each engaging portion 105 in its extending direction) may flex or deflect in the right-left direction 8 and 9 due to its elasticity. Each engaging portion 105 has an opening 105A that penetrates therethrough in the right-left direction 8 and 9. Each opening 105A is formed at a position corresponding to the protrusion 86 formed on a respective one of the side walls 84 and 85 of the casing 14 when the cover member 100 is at a position as depicted in FIGS. 1 and 4. Accordingly, the protrusion 86 may be inserted into the corresponding opening 105A.

The right and left operative portions 106 are provided along the right-left direction 8 and 9. Each of the operative portions 106 is provided in a respective one of the openings 101B formed in the first wall 101. The right operative portion 106 provided in the right opening 101B includes a right surface 106A facing rightward. The left operative portion 106 provided in the left opening 101B includes a left surface 106B facing leftward. In the illustrative embodiment, each operative portion 106 is integrally formed with a respective one of the movable members 121 of the restricting mechanism 120 to be described below. Each operative portion 106 is configured to move in the right-left direction 8 and 9. The right operative portion 106 is operated by a user pressing the right surface 106A leftward. The left operative portion 106 is operated by a user pressing the left surface 106B rightward.

The cover member 100 is configured to pivot about the pair of protruding portions 104 between a first position as depicted in FIGS. 1 and 4, and a second position as depicted in FIGS. 2 and 5.

When the cover member 100 is at the first position, the cover member 100 covers the opening portion 13, so that the rear surface 101A of the first wall 101 is flush with the rear surface 22 of the casing 14. When the cover member 100 is at the first position, each third wall 103 and each engaging portion 105 face or oppose a corresponding one of the side walls 84 and 85 of the casing 14 in the right-left direction 8 and 9. At this time, each protrusion 86 formed on a respective one of the side walls 84 and 85 of the casing 14 is inserted into the opening 105A of a corresponding one of the engaging portions 105. For example, each engaging portion 105 and its corresponding protrusion 86 engage with each other. The outer guide member 18 faces the inner guide member 19 in the front-rear direction 6 and 7 to define the curve path 65A therebetween. The second wall 102 faces the guide member 33 in the up-down direction 4 and 5, and defines the label path 67.

When the cover member 100 is at the second position, a portion of the cover member 100 other than a lower end portion thereof comes out of the opening portion 13. Therefore, an upper end portion of the rear surface 101A of the first wall 101 is positioned further to the rear than the rear surface 22 of the casing 14. For example, the rear surface 101A is inclined relative to the rear surface 22. When the cover member 100 is at the second position, each third wall 103 and each engaging portion 105 do not face a corresponding one of the side walls 84 and 85 of the casing 14. At this time, each protrusion 86 formed on a respective one of the side walls 84 and 85 of the casing 14 is released from the opening 105A of a corresponding one of the engaging portions 105. Each engaging portion 105 is disengaged from a corresponding one of the protrusion 86. The outer guide member 18 does not face the inner guide member 19, and the curve path 65A is exposed to an exterior of the multi-functional apparatus 10. In this case, the outer guide member 18 does not define the curve path 65A. The second wall 102 does not face the guide member 33, and does not define the label path 67.

[Flaps 34]

For example, right and left flaps 34 (one flap 34 hidden by the other in FIGS. 4 and 5) are pivotally supported, by the outer guide member 18, at upper end portions of the cover member 100 at the first position. Each of the flaps 34 includes a pair of protrusions (not depicted), one of which protrudes rightward from a right end thereof and the other one of which protrudes leftward from a left end thereof. Each of the protrusions is inserted into a corresponding opening (not depicted) formed in the outer guide member 18. Accordingly, each flap 34 is pivotally supported by the outer guide member 18 about a pivot axis 36 passing through the centers of the protrusions and extending in the right-left direction 8 and 9. Each flap 34 may be supported by any portion of the cover member 100, e.g., the first wall 101, the second wall 102, and one of the third walls 103, other than the outer guide member 18.

As depicted in FIGS. 6 and 7, for example, two flaps 34 are provided with a space therebetween in the right-left direction 8 and 9. The number of the flaps 34 is not limited to two.

Each flap 34 includes a guide portion 38 and a first contact portion, e.g., a protruding portion 37. The guide portion 38 extends frontward and upward relative to the pivot axis 36. An undersurface of the guide portion 38 is configured to guide a sheet conveyed along the curve path 65A while contacting the sheet. The guide portion 38 has a curved shape.

As depicted in FIG. 7, the protruding portion 37 is formed at a respective one of the flaps 34. For example, each flap 34 includes one protruding portion 37. The protruding portion 37 protrudes rearward relative to the pivot axis 36. The protruding portion 37 is configured to contact and separate from a second contact portion, e.g., an inclined surface 124 of the corresponding movable member 121 of the restricting mechanism 120 (described below). Each flap 34 may include a plurality of protruding portions 37.

When the cover member 100 is at the first position, as depicted in FIGS. 3 and 4, the flap 34 is configured to pivot between a third position indicated by a solid line in FIGS. 3 and 4, and a fourth position indicated by a broken line in FIGS. 3 and 4. When the cover member 100 is at the second position, as depicted in FIG. 5, the flap 34 is held at the third position by the restricting mechanism 120, as will be described below.

When the cover member 100 is at the first position, the flap 34 is located at the third position by its own weight. In one example, the guide portion 38 is heavier than the protruding portion 37. Therefore, a protruding end portion 34A of the flap 34 contacts the inner guide member 19 from above due to its own weight. Further, in one example, the protruding end portion 34A is received by a recess formed in an upper surface of the inner guide member 19. Accordingly, the flap 34 at the third position blocks the curve path 65A from the straight path 65B. When the flap 34 is at the third position, the flap 34 is spaced from the guide member 32 in the up-down direction 4 and 5. Accordingly, the flap 34 at the third position opens the label path 67 and the bypass path 66 to the straight path 65B.

The flap 34 is contacted by and pushed by a sheet, from below, that is fed from the feed tray 20 and conveyed along the curve path 65A toward the junction 80 in the conveying direction 17. Therefore, the flap 34 is raised upward. Thus, the flap 34 pivots from the third position to the fourth position. When the flap 34 is at the fourth position, the protruding end portion 34A is located higher than the upper surface of the inner guide member 19. Accordingly, the flap 34 at the fourth position opens the curve path 65A to the straight path 65B. When the flap 34 is at the fourth position, the flap 34 is in contact with the guide member 32 from below. Accordingly, the flap 34 at the fourth position blocks the label path 67 and the bypass path 66 from the straight path 65B.

As long as the flap 34 at the fourth position is closer to the guide member 32 than the flap 34 at the third position, the flap 34 may not necessarily contact the guide member 32. For example, the flap 34 at the fourth position may not necessarily block the label path 67 and the bypass path 66 completely from the junction 80. For example, the flap 34 may partially block the label path 67 and the bypass path 66 from the junction 80, such that the media tray is prevented from being conveyed between the straight path 65B and the label path 67 and a sheet is prevented from being conveyed from the bypass path 66 to the straight path 65B.

When the cover member 100 is at the first position, the protruding end portion 34A of the flap 34 is located downstream of the junction 80 in the conveying direction 17. For example, when the cover member 100 is at the first position, a portion of the flap 34 extends further toward the straight path 65B beyond the junction 80.

As depicted in FIG. 4, a distance L1 from the pivot axis 46 of the cover member 100 to a distal end of the flap 34 at the fourth position is longer than a distance L2 from the pivot axis 46 of the cover member 100 to the distal end of the flap 34 at the third position.

As depicted in FIG. 4, when the cover member 100 is at the first position, the protruding end portion 34A of the flap 34 at the fourth position is located higher than the protruding end portion 34A of the flap 34 at the third position. For example, when the cover member 100 is at the first position, a length L3 in the up-down direction 4 and 5 from the pivot axis 36 to the distal end of the flap 34 at the fourth position is longer than a length L4 in the up-down direction 4 and 5 from the pivot axis 36 to the distal end of the flap 34 at the third position. The flap 34 at the third position protrudes vertically by the length L3. The flap 34 at the fourth position protrudes vertically by the length L4. The up-down direction 4 and 5, e.g., a vertical direction, is a direction orthogonal to a pivoting direction of the cover member 100 at the first position. The pivoting direction of the cover member 100 at the first position is defined as a direction tangent to a pivoting direction of the cover member 100 at the moment when the cover member 100 at the first position pivots toward the second position, e.g., the rear direction 7. The up-down direction 4 and 5 is an example of an orthogonal direction in the disclosure. The rear direction 7 is an example of a movement direction in the disclosure.

As depicted in FIG. 5, when the cover member 100 pivots between the first position and the second position, a pivoting path 130 of the flap 34 at the third position (as depicted by a broken line in FIG. 5) is positioned distinct from any members (e.g., guide member 33 and the bypass tray 70) provided in the multi-functional apparatus 10 other than the cover member 100.

In the illustrative embodiment, when the cover member 100 pivots with the flap 34 at the fourth position, the flap 34 may contact a member which is other than the cover member 100 and is provided in the vicinity of the flap 34.

[Restricting Mechanism 120]

Figure 9:
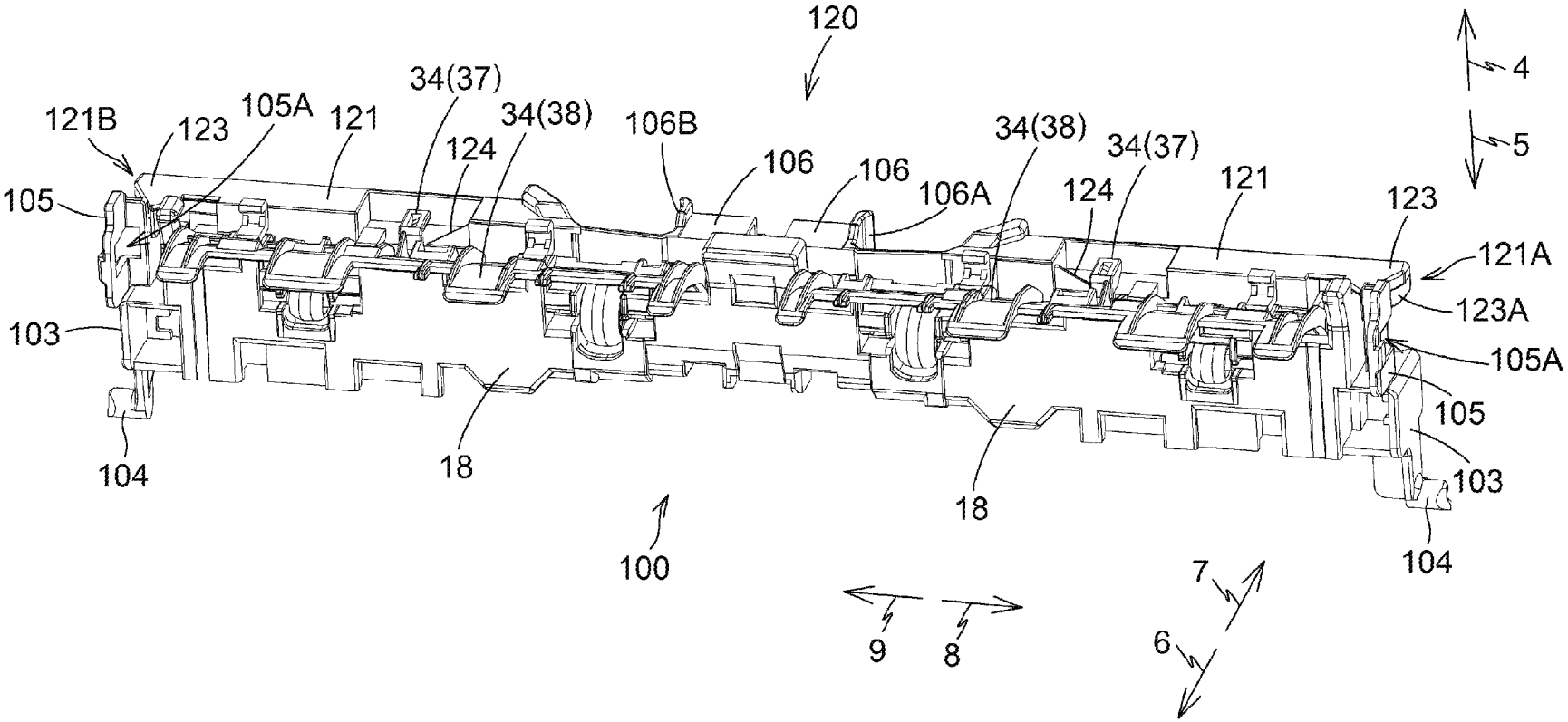
FIG. 9 is a perspective view of the cover member when the movable members 121 are at the respective non-contact positions, in which the first wall and the second wall are omitted.

The printer unit 11 includes the restricting mechanism 120 as depicted in FIGS. 7 and 9. As will be described below, the restricting mechanism 120 is configured to pivot together with the cover member 100. In the following description of structures of the restricting mechanism 120, the up direction 4, the down direction 5, the front direction 6, the rear direction 7, the right direction 8, and the left direction 9 are defined in conjunction with an orientation in which the cover member 100 is at a position depicted in FIGS. 1 and 4, e.g., the first position.

The restricting mechanism 120 is configured to selectively allow and restrict pivoting of each flap 34 to the respective fourth positions. The restricting mechanism 120 includes a pair of movable members 121, e.g., right and left movable members 121, and an urging member, e.g., a coil spring 122.

The movable members 121 are provided at the cover member 100. The movable members 121 are supported by the fourth wall 107 of the cover member 100 to move in the right-left direction 8 and 9. The movable members 121 are disposed with a space therebetween in the right-left direction 8 and 9. Each of the movable members 121 has an operative portion 106 formed thereon. Each operative portion 106 is formed at a position corresponding to the respective one of the openings 101B formed in the first wall 101 of the cover member 100.

In the illustrative embodiment, each operative portion 106 is integrally formed with a respective one of the movable members 121. In another embodiment, the operative portion 106 may not necessarily be integrally formed with the movable member 121 as along as the operative portion 106 has a function (e.g., to disengage the engaging portion 105 from the corresponding protrusion 86) as will be described below. For example, the operative portion 106 may be movably supported by the first wall 101. As the movable member 121 moves in response to the movement of the operative portion 106, the engaging portion 105 may be disengaged from the corresponding protrusion 86.

Right and left protruding portions 123, each protruding frontward, are formed at a right end portion 121A of the right movable member 121, and a left end portion of 121B of the left movable member 121, respectively. The right protruding portion 123 is configured to contact the right engaging portion 105 of the cover member 100 from the right. The left protruding portion 123 is configured to contact the left engaging portion 105 from the left.

Each of the movable members 121 has an inclined surface 124 formed thereon. Each inclined surface 124 is formed at a position corresponding to the protruding portion 37 of a respective one of the flaps 34. The inclined surface 124 formed on the right movable member 121 is inclined upwardly from the right to the left. The inclined surface 124 formed on the left movable member 121 is inclined upwardly from the left to the right. Each inclined surface 124 is configured to contact a corresponding protruding portion 37 from below.

The coil spring 122 is disposed between the movable members 121. One end of the coil spring 122 is connected to a left end of the right movable member 121. The other end of the coil spring 122 is connected to a right end of the left movable member 121. Other urging members, e.g., a plate spring, may be used instead of the coil spring 122.

Figure 8:
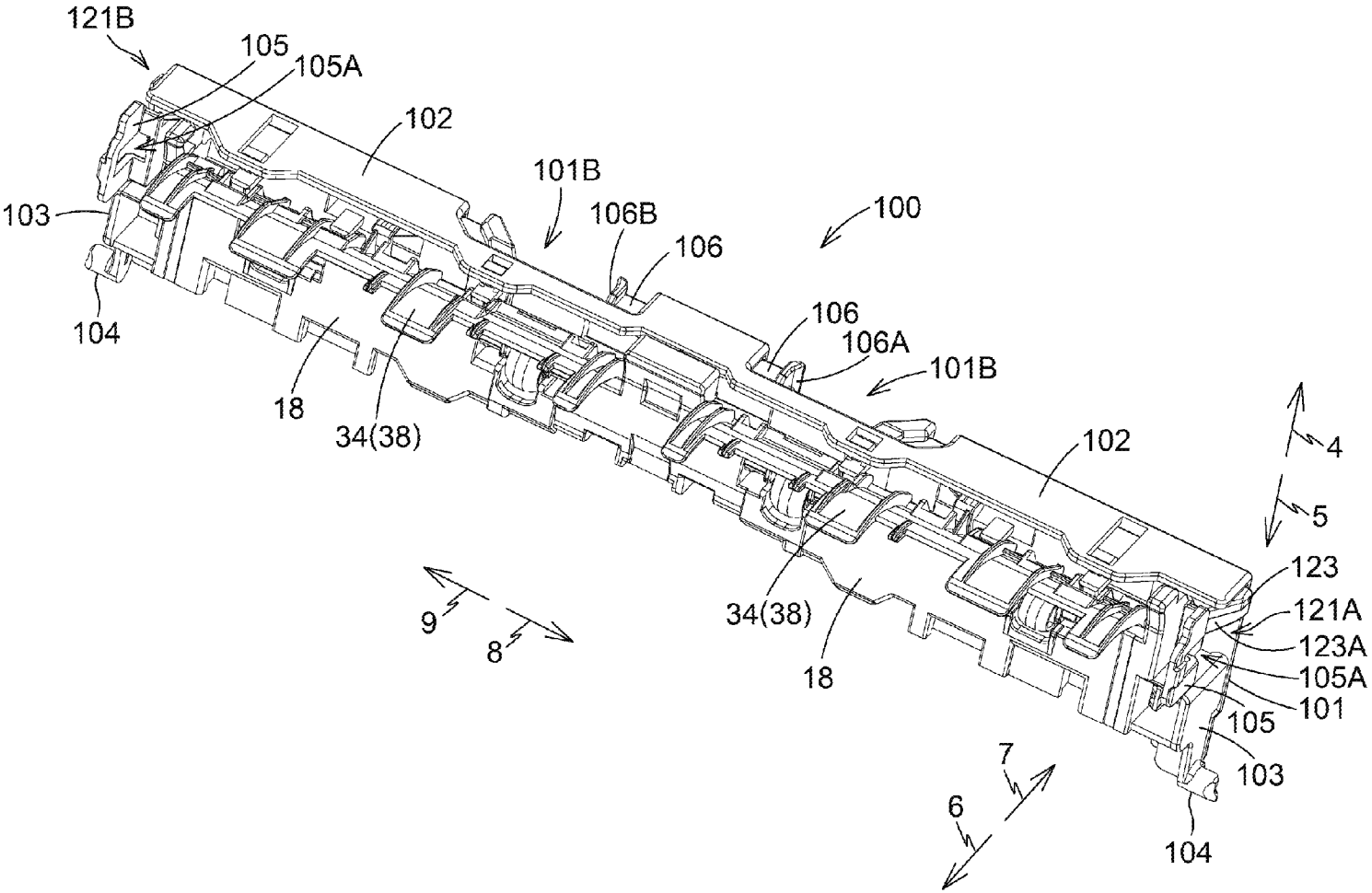
FIG. 8 is a perspective view of the cover member when the movable members 121 are at respective non-contact positions and flaps of the printer unit are at respective third positions.
Figure 10:
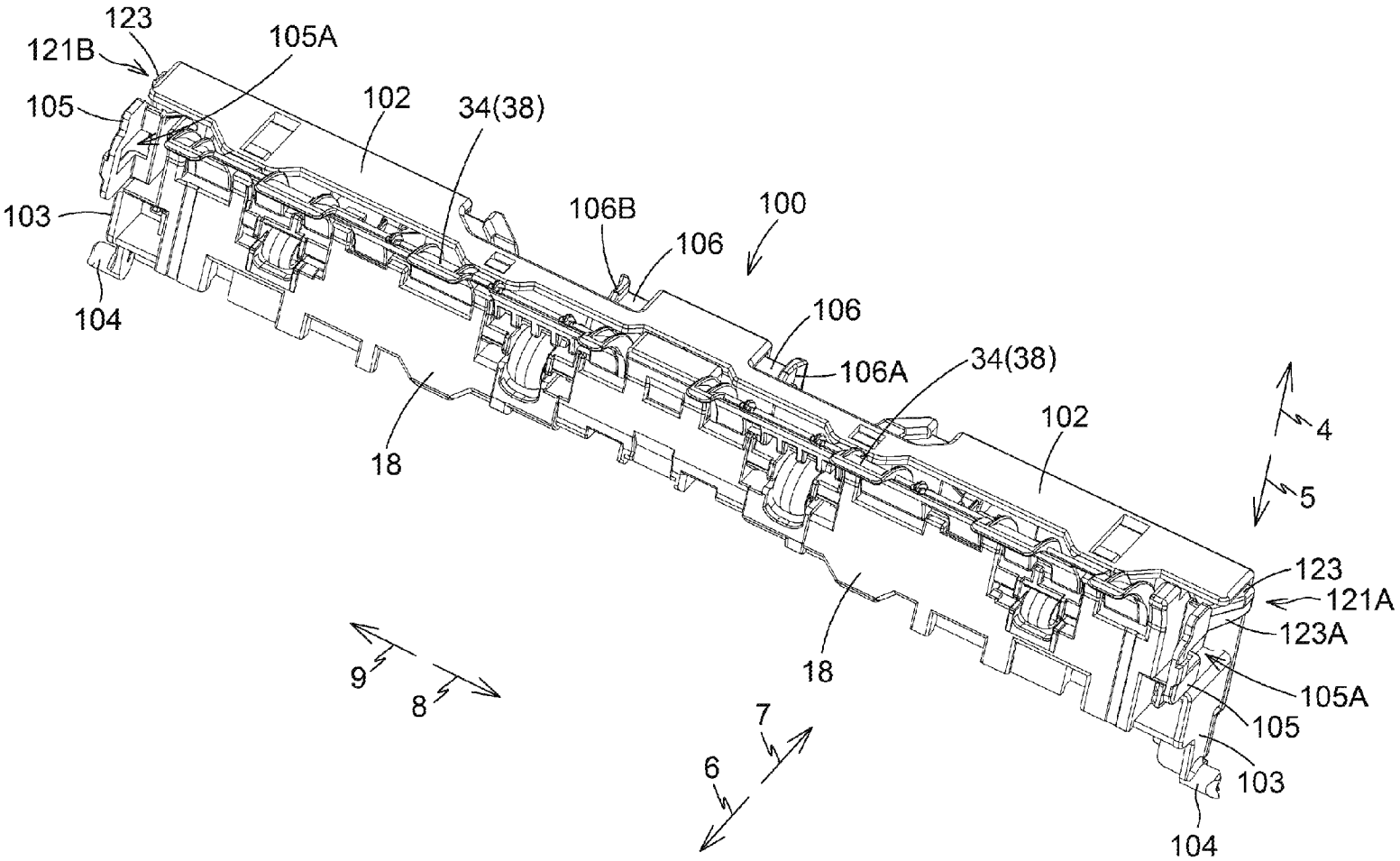
FIG. 10 is a perspective view of the cover member when the movable members 121 are at the respective non-contact positions and the flaps are at respective fourth positions.
Figure 11:
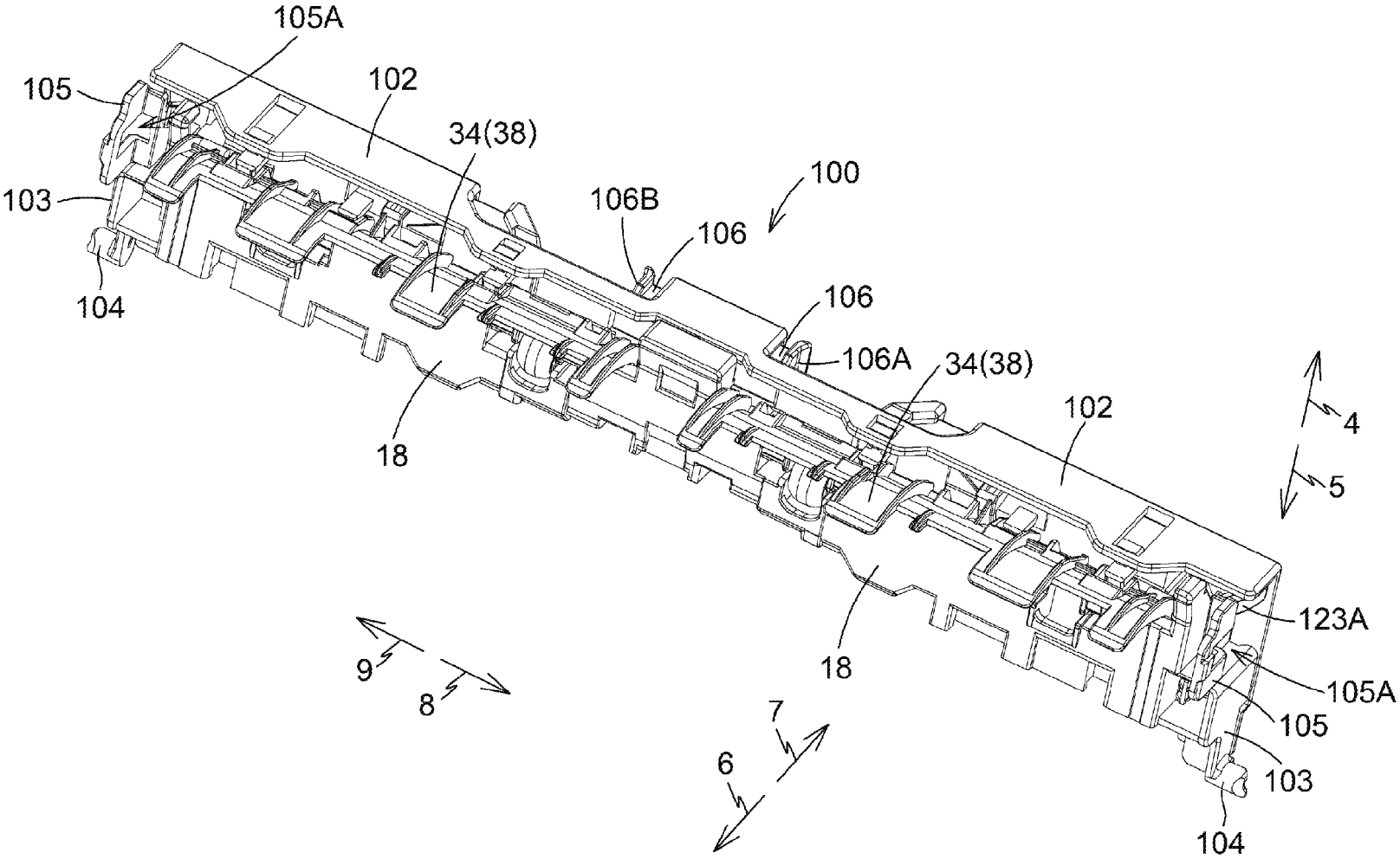
FIG. 11 is a perspective view of the cover member when the movable members are at respective far positions.

Each movable member 121 is configured to move along the right-left direction 8 and 9, between a contact position as depicted in FIGS. 6 and 7, a non-contact position as depicted in FIGS. 8-10, and a far position as depicted in FIG. 11.

The coil spring 122 has a natural length when the right end portion 121A and the left end portion 121B of the right and left movable members 121, respectively, are not in contact with any members. At this time, the movable members 121 are maintained at the respective contact positions. When the cover member 100 is at a position other than the first position, e.g., at the second position, the right end portion 121A and the left end portion 121B are not in contact with any members. Accordingly, the movable members 121 are maintained at the respective contact positions as depicted in FIGS. 6 and 7.

When the right movable member 121 is at its contact position, the right end portion 121A is located further toward the right than the first wall 101, the second wall 102, the right third wall 103, and the right engaging portion 105 of the cover member 100. When the left movable member 121 is at its contact position, the left end portion 121B is located further toward the left than the first wall 101, the second wall 102, the left third wall 103, and the left engaging portion 105 of the cover member 100. Each protruding portion 123 is spaced from a corresponding engaging portion 105.

When each movable member 121 is at its contact position, each inclined surface 124 is in contact with the protruding portion 37 of a corresponding one of the flaps 34 from below and presses the protruding portion 37 upwardly. In short, each movable member 121 is in contact with a corresponding one of the flaps 34. Accordingly, the guide portion 38 of each flap 34 is maintained pivoted down. Each flap 34 is maintained at the third position and restricted from moving to the fourth position. Thus, the restricting mechanism 120 restricts pivotal movement of each flap 34 to its fourth position when the cover member 100 is not at the first position.

When the cover member 100 is at the first position, the cover member 100 covers the opening portion 13 of the casing 14. At this time, the right end portion 121A of the right movable member 121 and the left end portion 121B of the left movable member 121 are in contact with the side walls 84 and 85, respectively and pressed by the side walls 84 and 85 against the urging force of the coil spring 122. At this time, the movable members 121 are at the respective non-contact positions. For example, the coil spring 122 urges the movable members 121 from the respective non-contact positions toward the respective contact positions. Thus, the movable members 121 are maintained at the respective non-contact positions as depicted in FIGS. 8-10 when the cover member 100 is at the first position.

The right movable member 121 at its non-contact position is located further to the left than at its contact position. The left movable member 121 at its non-contact position is located further to the right than at its contact position. The protrusions 86 formed on the respective side walls 84 and 85 are inserted into the corresponding openings 105A formed in the engaging portions 105. Accordingly, the cover member 100 is maintained at the first position and restricted from moving to the second position. The protruding portions 123 are spaced from the corresponding engaging portions 105, similar to when the movable members 121 are at the respective contact positions.

An inclined surface 124 of each movable member 121 at its non-contact position is spaced from or out of contact with the protruding portion 37 of a corresponding flap 34. In short, each movable member 121 is spaced from or out of contact with a corresponding flap 34. Accordingly, the guide portion 38 of each flap 34 may freely pivot in the up-down direction 4 and 5. For example, each flap 34 may freely pivot between its third position as depicted in FIG. 8 and its fourth position as depicted in FIG. 10. Thus, the restricting mechanism 120 allows each flap 34 to freely pivot between its third position and its fourth position when the cover member 100 is at the first position.

The movable members 121 are configured to move from the respective non-contact positions to the respective far positions as depicted in FIG. 11 in response to the operative portions 106 operated by a user. In one example, when the right surface 106A is pressed leftward by a user, the right movable member 121 moves to its far position, which is located further toward the left than its non-contact position, against the urging force of the coil spring 122. When the left surface 106B is pressed rightward by the user, the left movable member 121 moves to its far position, which is located further toward the right than its non-contact position, against the urging force of the coil spring 122.

When the operative portions 106 are operated by the user with the cover member 100 at the first position, the movable members 121 move from the respective non-contact positions to the respective far positions and the protruding portions 123 contact the corresponding engaging portions 105. The engaging portions 105 are pressed by the protruding portions 123 and flexed. In one example, the right engaging portion 105 is flexed leftward, and the left engaging portion 105 is flexed rightward. Accordingly, the protrusions 86 formed on the side walls 84 and 85 come out of the corresponding openings 105A formed in the engaging portions 105. The engaging portions 105 are disengaged from the corresponding protrusions 86, so that the cover member 100 may move to the second position.

[Pivotal Movement of Cover Member 100]

Pivotal movement of the cover member 100 from the second position to the first position will be described below. When the cover member 100 is at the second position, as depicted in FIGS. 2 and 5, each movable member 121 is at its contact position as depicted in FIGS. 6 and 7. At this time, the inclined surface 124 of each movable member 121 is in contact with the protruding portion 37 of a corresponding flap 34 from below. Accordingly, each flap 34 is maintained at its third position.

As the user presses the rear surface 101A (refer to FIG. 1) of the first wall 101, the cover member 100 pivots from the second position to the first position. At this time, each flap 34 is maintained at its third position, thereby not interfering with any members provided in the multi-functional apparatus 10 other than the cover member 100.

As the cover member 100 pivots from the second position toward the first position and is inserted into the opening portion 13 of the casing 14 (refer to FIGS. 1 and 4), inclined surfaces 123A (refer to FIG. 6) formed on the protruding portions 123 of the movable members 121 contact the corresponding side walls 84 and 85 (refer to FIG. 2). The inclined surfaces 123A are guided along the corresponding side walls 84 and 85. Accordingly, the right end portion 121A of the right movable member 121 is pressed by the side wall 84 against the urging force of the coil spring 122, and the left end portion 121B of the left movable member 121 is pressed by the side wall 85 against the urging force of the coil spring 122. Consequently, the movable members 121 move from the respective contact positions to the respective non-contact positions (refer to FIGS. 8-10).

While each movable member 121 is moving from its contact position to its non-contact position, the inclined surface 124 of each movable member 121 moves away from the protruding portion 37 of a corresponding flap 34 (refer to FIG. 9). Accordingly, the corresponding flap 34 may freely pivot between its third position (refer to FIG. 8) and its fourth position (refer to FIG. 10).

As the cover member 100 reaches the first position, the protrusions 86 formed on the side walls 84 and 85 are inserted into the corresponding openings 105A formed on the engaging portions 105. Accordingly, the cover member 100 is maintained at the first position and restricted from moving to the second position.

Next, pivotal movement of the cover member 100 from the first position to the second position will be described. When the operative portions 106 are operated with the cover member 100 at the first position, e.g., when the surfaces 106A and 106B are pressed leftward and rightward, respectively, the movable members 121 move from the respective non-contact positions to the respective far positions. Accordingly, the engaging portions 105 are pressed by the corresponding protruding portions 123 and flexed. Consequently, the protrusions 86 are disengaged from the corresponding openings 105A to allow the cover member 100 to move to the second position.

Then, when the user pivots the cover member 100 toward the second position by holding the operative portions 106, the cover member 100 comes out of the opening portion 13 of the casing 14 and reaches the second position eventually. Because the user holds the operative portions 106 during pivoting of the cover member 100 from the first position to the second position, the movable members 121 are maintained at the respective far positions. Therefore, the flaps 34 are freely pivotable between the respective third positions and the respective fourth positions. If the flaps 34 pivot to the respective fourth positions during pivoting of the cover member 100 from the first position to the second position, the flaps 34 may interfere with any members (e.g., the guide members 32 and 33) provided in the multi-functional apparatus 10 other than the cover member 100. Even when the flaps 34 interfere with the guide members 32 and 33, the flaps 34 may contact the guide members 32 and 33 from below, so that the flaps 34 may pivot back to the respective third positions from the respective fourth positions. This allows the cover member 100 to pivot to the second position (refer to FIGS. 2 and 5).

In contrast, when the user releases the operative portions 106 before the cover member 100 comes out of the opening portion 13 during pivoting from the first position to the second position, the movable members 121 move from the respective far positions to the respective non-contact positions. At the moment when the cover member 100 comes out of the opening portion 13, the movable members 121 are separated from the corresponding side walls 84 and 85 and move from the respective non-contact positions to the respective contact positions by the urging force of the coil spring 122.

In contrast, when the user releases the operative portions 106 after the cover member 100 comes out of the opening portion 13 during pivoting from the first position to the second position, the movable members 121 move from the respective far positions to the respective contact positions.

While the movable members 121 are moving to the respective contact positions, the inclined surfaces 124 of the movable members 121 contact the protruding portions 37 of the corresponding flaps 34 from below. The protruding portions 37 are guided along the inclined surfaces 124 and move upward (refer to FIG. 7). Accordingly, the flaps 34 are maintained at the respective third positions. The cover member 100 pivots to the second position with the flaps 34 maintained at the respective third positions (refer to FIGS. 2 and 5).

[Effects of Illustrative Embodiment]

The length L3 in the up-down direction 4 and 5 from the pivot axis 36 to the distal end of the flap 34 at the fourth position is longer than the length L4 in the up-down direction 4 and 5 from the pivot axis 36 to the distal end of the flap 34 at the third position. Therefore, when the cover member 100 moves between the first position and the second position, a range of a moving path of the flap 34 maintained at the fourth position increases as compared with a range of a moving path (e.g., pivoting path 130) of the flap 34 maintained at the third position. According to the illustrative embodiment, when the cover member 100 is not at the first position, the restricting mechanism 120 restricts the pivotal movement of the flap 34 to the fourth position. Accordingly, the range of the moving path of the flap 34 when the cover member 100 moves between the first position and the second position may be reduced. Consequently, this may reduce a possibility that the flap 34 interferes with any members provided in the multi-functional apparatus 10 other than the cover member 100 when the cover member 100 moves between the second position and the first position.

According to the illustrative embodiment, when the cover member 100 is at the first position, the restricting mechanism 120 allows the flaps 34 to freely pivot. Accordingly, the flaps 34 may readily pivot as a sheet conveyed along the curve path 65A contacts the flaps 34. This may reduce resistance applied by the flaps 34 to a sheet being conveyed.

According to the illustrative embodiment, the movable members 121 may be located at the respective non-contact positions in response to the cover member 100 moved to the first position. When the cover member 100 is at the first position, the movable members 121 may be maintained at the respective non-contact positions. Accordingly, when the cover member 100 is at the first position, the flaps 34 may freely pivot.

According to the illustrative embodiment, the movable members 121 may be located at the respective contact positions by the urging force of the coil spring 122, in response to the cover member 100 moving from the first position toward the second position. Accordingly, when the cover member 100 is not at the first position, the flaps 34 may be maintained at the respective third positions.

According to the illustrative embodiment, the engaging portions 105 engage the corresponding protrusions 86, so that the cover member 100 may be maintained at the first position. As the operative portions 106 are operated to move the movable members 121 from the respective non-contact positions to the respective far positions, the engaging portions 105 may be disengaged from the corresponding protrusions 86. Accordingly, the cover member 100 may move from the first position toward the second position.

According to the illustrative embodiment, the distance L1 from the pivot axis 46 of the cover member 100 to the distal end of the flap 34 at the fourth position is longer than the distance L2 from the pivot axis 46 of the cover member 100 to the distal end of the flap 34 at the third position. This may reduce or prevent increase in the range of the moving path of the flap 34 when the cover member 100 moves from the first position to the second position.

According to the illustrative embodiment, the pivoting path 130 of the flap 34 at the third position when the cover member 100 pivots between the first position and the second position, is entirely distinct from the positions of any members provided in the multi-functional apparatus 10 other than the cover member 100. Therefore, when the cover member 100 moves between the first position and the second position, the flap 34 at the third position may be reduced or prevented from interfering with the members.

In the illustrative embodiment, a portion of the flap 34 extends further toward the straight path 65B beyond the junction 80. However, as described above, when the cover member 100 is not at the first position, the restricting mechanism 120 restricts the pivotal movement of the flap 34 to the fourth position. Therefore, increase in the pivoting range of the flap 34 may be reduced or prevented when the cover member 100 moves between the first position and the second position.

[Modification]

In the above-described illustrative embodiment, the cover member 100 is configured to pivot between the first position and the second position. In another embodiment, the cover member 100 may be configured to move, other than pivoting, between the first position and the second position. For example, the cover member 100 may be configured to move between the first position and the second position by attaching and removing the cover member 100 to and from the casing 14.

Figure 12:
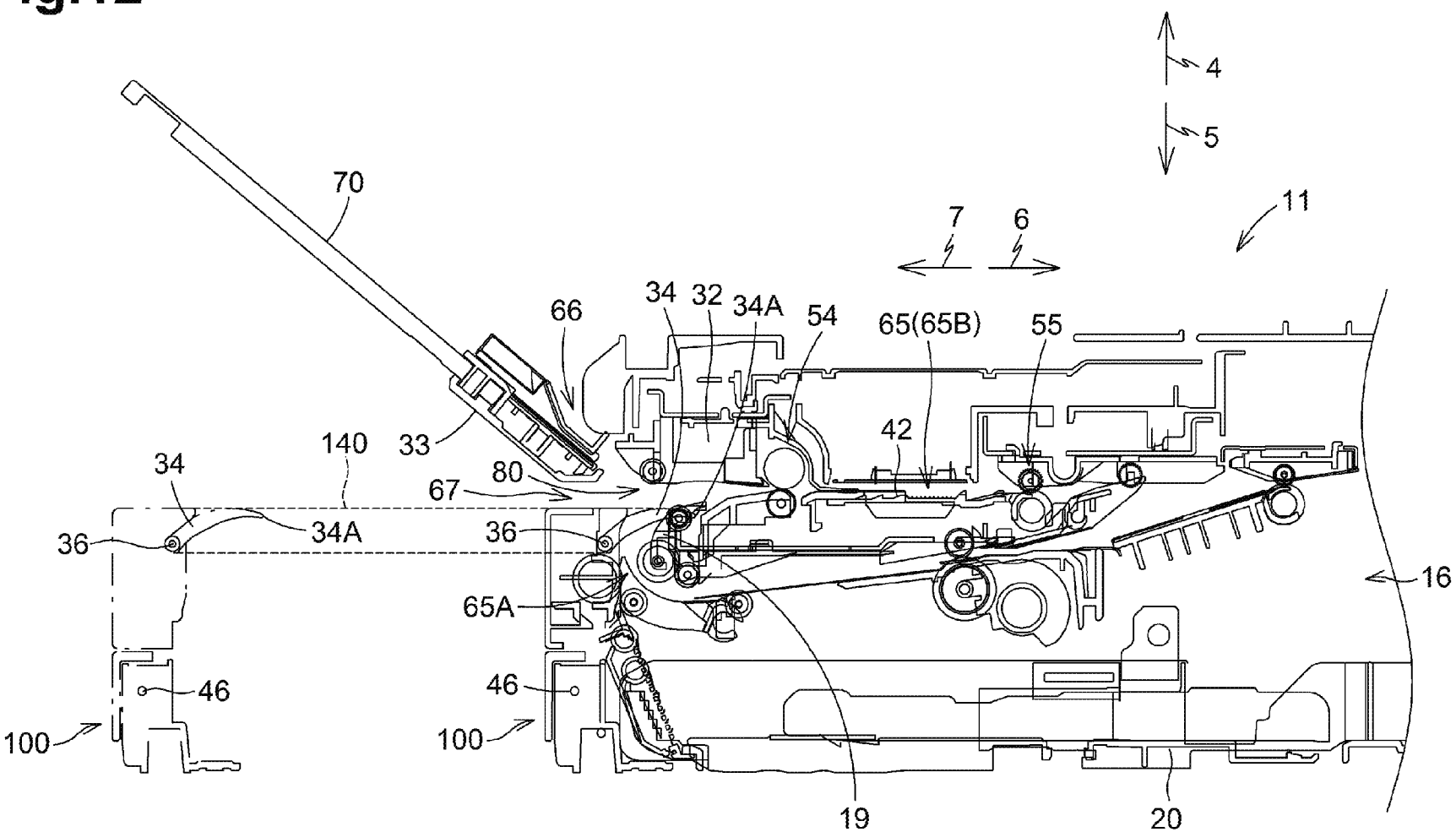
FIG. 12 is a vertical cross-sectional view of a printer unit according to a modification of the illustrative embodiment, depicting internal structure of the printer unit.

For example, as depicted in FIG. 12, the cover member 100 may be configured to be removed from the casing 14 by moving the cover member 100 rearward and attached to the casing 14 by moving the cover member 100 frontward. In FIG. 12, the cover member 100 at the first position and the flap 34 supported by the cover member 100 are depicted by solid lines, and the cover member 100 at the second position and the flap 34 supported by the cover member 100 are depicted by dot-and-dash lines.

In the structure as depicted in FIG. 12, relationship between the lengths L3 and L4 is similar to that as depicted in FIG. 4. For example, as depicted in FIG. 4, when the cover member 100 is at the first position, the protruding end portion 34A of the flap 34 at the fourth position is located higher than the protruding end portion 34A of the flap 34 at the third position. For example, when the cover member 100 is at the first position, the length L3 in the up-down direction 4 and 5 from the pivot axis 36 to the distal end of the flap 34 at the fourth position is longer than the length L4 in the up-down direction 4 and 5 from the pivot axis 36 to the distal end of the flap 34 at the third position. The up-down direction 4 and 5 is a direction orthogonal to the rear direction 7 in which the cover member 100 moves from the first position. In the structure as depicted in FIG. 12, the up-down direction 4 and 5 is an example of an orthogonal direction in the disclosure. The rear direction 7 is an example of a movement direction in the disclosure.

As depicted in FIG. 12, a moving path 140 (e.g., an area enclosed by a broken line in FIG. 12) of the flap 34 at the third position when the cover member 100 moves in the front-rear direction 6 and 7 between the first position and the second position is positioned distinct from any members provided in the multi-functional apparatus 10, other than the cover member 100.

In the above-described illustrative embodiment, when the cover member 100 is not at the first position, the flap 34 is maintained at the third position. However, the flap 34 may be configured to pivot from the third position but not to the fourth position when the cover member 100 is not at the first position. For example, the flap 34 may be configured to pivot from the third position to such an extent that the flap 34 does not contact any members provided in the multi-functional apparatus 10 other than the cover member 100 when the cover member 100 pivots between the first position and the second position.

In the above-described illustrative embodiment, the conveying device is provided in the printer unit 11. However, the conveying device may not necessarily be provided in the printer unit 11. In another embodiment, the conveying device may be provided in, for example, the scanner unit 12.

What is claimed is:

1. A conveying device comprising:

a casing;

a cover member including a guide portion and configured to move relative to the casing between a first position at which the guide portion defines a first conveying path, and a second position at which the guide portion exposes the first conveying path to an exterior of the conveying device;

a conveying unit configured to convey a medium along a second conveying path;

a flap supported by the cover member and pivotable about a pivot axis between a third position and a fourth position, the flap being configured to guide the medium toward the conveying unit, and the flap including a first contact portion; and a restricting mechanism disposed at the cover member and including a second contact portion, the restricting mechanism being configured such that:

when the cover member is at the first position, the second contact portion is spaced from the first contact portion of the flap to allow the flap to pivot between the third position and the fourth position; and when the cover member is not at the first position, the second contact portion is in contact with the first contact portion of the flap to maintain the flap at the third position.

2. The conveying device according to claim 1, wherein the first contact portion of the flap includes a protruding portion, and the second contact portion of the restricting mechanism includes an inclined surface.

3. The conveying device according to claim 1, wherein when the cover member is at the first position, a length in an orthogonal direction from the pivot axis to a free end of the flap at the fourth position is longer than a length in the orthogonal direction from the pivot axis to the free end of the flap at the third position, the orthogonal direction being orthogonal to a moving direction of the cover member.

4. The conveying device according to claim 1, wherein when the cover member is at the first position, the flap at the third position blocks the first conveying path from the second conveying path, and the flap at the fourth position opens the first conveying path to the second conveying path.

5. The conveying device according to claim 1, wherein the guide portion of the cover member has a curved surface configured to define the first conveying path.

6. The conveying device according to claim 1, wherein a moving range of the flap held at the third position when the cover member moves between the first position and the second position is entirely distinct from positions of any members, other than the cover member, provided in the conveying device.

7. The conveying device according to claim 1, wherein when the cover member is at the first position, the flap extends toward the second conveying path beyond a junction between the first conveying path and the second conveying path.

8. The conveying device according to claim 1, wherein the restricting mechanism further includes a movable member which includes the second contact portion and is movable between a contact position at which the second contact portion is in contact with the flap and maintains the flap at the third position, and a non-contact position at which the second contact portion is spaced from the flap.

9. The conveying device according to claim 8, wherein the casing includes an opening for accommodating the cover member located at the first position, and a side wall partially defining the opening and configured to face the cover member located at the first position in a width direction orthogonal to a conveying direction in which the medium is conveyed along the first conveying path, and wherein the restricting mechanism further includes an urging member configured to urge the movable member toward the contact position, and the movable member of the restricting mechanism is configured to, when the cover member is at the first position, contact the side wall so as to be maintained at the non-contact position against an urging force of the urging member.

10. The conveying device according to claim 8, wherein the casing includes an engaged portion, and wherein the cover member includes:

an engaging portion configured to engage the engaged portion when the cover member is at the first position; and an operative portion configured to be operated to move the movable member, and wherein the movable member is movable to a far position, which is farther from the contact position than the non-contact position, and configured to, when moved from the non-contact position to the far position through operation of the operative portion, press the engaging portion and release the engaging portion from the engaged portion.

11. The conveying device according to claim 8, wherein when the cover member is located at the first position, the movable member is movable in a width direction orthogonal to a conveying direction in which the medium is conveyed along the first conveying path.

12. The conveying device according to claim 1, wherein the flap is configured to, when the cover member is at the first position:

stay at the third position by an own weight thereof; and pivot from the third position to the fourth position upon being contacted by the medium conveyed along the first conveying path toward a junction between the first conveying path and the second conveying path.

13. The conveying device according to claim 12, wherein a third conveying path is defined inside the casing and extends in an opposite direction relative to the second conveying path from the junction between the first conveying path and the second conveying path, and wherein the flap is configured to:

when at the third position, block the first conveying path from the second conveying path and open the third conveying path to the second conveying path; and when at the fourth position, open the first conveying path to the second conveying path and block the third conveying path from the second conveying path.

14. The conveying device according to claim 12, further comprising a tray, wherein a medium supported by the tray is guided along a fourth conveying path which extends toward the junction between the first conveying path and the second conveying path, and wherein the flap is configured to:

when at the third position, block the first conveying path from the second conveying path and open the fourth conveying path to the second conveying path; and when at the fourth position, open the first conveying path to the second conveying path and block the fourth conveying path from the second conveying path.

15. The conveying device according to claim 1, wherein the cover member is supported by the casing and pivotable about a pivot axis.

16. The conveying device according to claim 15, wherein a distance from the pivot axis of the cover member to a free end of the flap at the fourth position is longer than a distance from the pivot axis of the cover member to the free end of the flap at the third position.

17. An image recording apparatus comprising:

a recording unit configured to record an image on a medium; and a conveying device including:

a casing;

a cover member including a guide portion and configured to move relative to the casing between a first position at which the guide portion defines a first conveying path, and a second position at which the guide portion exposes the first conveying path to an exterior of the conveying device;

a conveying unit configured to convey the medium to the recording unit along a second conveying path;

a flap supported by the cover member and pivotable about a pivot axis between a third position and a fourth position, the flap being configured to guide the medium toward the conveying unit, and the flap including a first contact portion; and a restricting mechanism disposed at the cover member and including a second contact portion, the restricting mechanism being configured such that:

when the cover member is at the first position, the second contact portion is spaced from the first contact portion of the flap to allow the flap to pivot between the third position and the fourth position; and when the cover member is not at the first position, the second contact portion is in contact with the first contact portion of the flap to maintain the flap at the third position.

* * * * *